United States Patent [19]

Nishino et al.

[11] Patent Number: 4,465,458

[45] Date of Patent: Aug. 14, 1984

[54] APPARATUS FOR BURNING LIQUID FUEL EQUIPPED WITH HEATING-TYPE FUEL VAPORIZER

[75] Inventors: Atsushi Nishino, Neyagawa; Kazunori Sonetaka, Hirakata; Yasuhiro Takeuchi, Moriguchi, all of Japan

[73] Assignee: Matsushita Electric Industrial Co., Ltd., Osaka, Japan

[21] Appl. No.: 387,686

[22] Filed: Jun. 11, 1982

Related U.S. Application Data

[63] Continuation of Ser. No. 131,801, Mar. 19, 1980, abandoned.

[51] Int. Cl.[3] ..... F23D 11/44

[52] U.S. Cl. ..... 431/208; 431/241; 431/121; 219/274; 261/142; 261/107

[58] Field of Search ..... 431/207, 208, 210, 240, 431/241, 3, 121, 262, 325, 326, 328; 219/271, 273, 274, 275; 261/141, 142, 99, 107

[56] References Cited

U.S. PATENT DOCUMENTS 2,507,464 5/1950 de Andrade So ..... 431/241

4,365,952 12/1982 Ohmukai et al. ..... 431/208

FOREIGN PATENT DOCUMENTS 54-124340 9/1979 Japan ..... 431/208

*Primary Examiner*—Lee E. Barrett

*Attorney, Agent, or Firm*—Joseph W. Farley

[57] ABSTRACT

A liquid fuel combustion apparatus for evaporating and vaporizing kerosene, gas oil or like liquid fuel by heating, admixing air with the vaporized fuel in a specified ratio and burning the resulting gaseous mixture in a combustion unit. The vaporizer for the liquid fuel comprises a liquid fuel drawing-up member (15) made of a heat-resistant porous body (8) or heat-resistant inorganic fiber fabric (9) for drawing up the liquid fuel, and a heat generating member (6) including coating layers (22, 23) of heat-resistant metal, heat-resistant alloy or heat-resistant metallic oxide for giving heat to the drawing-up member. To prevent formation of tar-like substances, a catalyst is preferably deposited on the surface of the drawing-up member and/or on the surface of the heat generating member. Further preferably, the outer periphery of the heat generating member (6) is in contact with the drawing-up member (5). The apparatus assures stable combustion over a prolonged period of time and is useful as a heater, kitchen range or the like.

6 Claims, 13 Drawing Figures

APPARATUS FOR BURNING LIQUID FUEL EQUIPPED WITH HEATING-TYPE FUEL VAPORIZER

This is a continuation of application Ser. No. 06/131,801, filed Mar. 19, 1980, now abandoned.

The present invention relates to a liquid fuel combustion apparatus for evaporating and vaporizing kerosene, gas oil or like liquid fuel, admixing a specified quantity of air with the vaporized fuel and burning the resulting gaseous mixture in a combusion unit.

A majority of conventional devices for vaporizing kerosene by heating, which are divided generally into the stationary type and the rotary type, operate on the principle that kerosene is vaporized by being applied to the surface of a metal member having a relatively large thermal capacity and maintained at a temperature sufficiently higher than the boiling point of kerosene as by electrical heat. These devices require a preheating period of several minutes to more than ten minutes for start-up and have a problem from the viewpoint of savings of energy in that the power consumption involved is exceedingly large as compared with thermal energy needed for the vaporization of kerosene. The conventional devices have another problem that soft carbon, hard carbon, tar and like unburned deposits formed on the kerosene vaporizing portion adversely affect combustion. Additionally the conventional devices are not always adapted for accurate control of the amount of kerosene to be vaporized and are therefore likely to give off an exhaust gas of objectionable composition especially when affording a reduced calorific value. Thus they have various drawbacks.

The object of the present invention is to provide a combustion apparatus equipped with a fuel vaporizer in which a liquid fuel is drawn up by a drawing-up member and then evaporated with the heat energy generated by a heat generating member to form a vaporized fuel rapidly, smoothly and efficiently at the desired rate, the fuel vaporizing portion having reduced susceptibility to the formation of tar and like deposits and being capable of vaporizing the liquid fuel steadily over a prolonged period of time, the fuel vaporizer therefore enabling a combustion unit to burn the fuel in a very satisfactory state, with improved stability and with a greatly reduced likelihood of giving off soot, CO or noxious odor.

According to a preferred embodiment, the invention provides a liquid fuel combustion apparatus which includes a liquid fuel drawing-up member and a heat generating member and in which formation of tar and other deposits is inhibited over a still prolonged period of time by a catalyst deposited at least on the surface of a liquid fuel vaporizing portion of the drawing-up member and/or on the surface of the heat generating member.

According to another preferred embodiment of the invention, there is provided a liquid fuel combustion apparatus of the type described above in which the outer periphery of the heat generating member is at least partly in contact with the fuel drawing-up member so that the thermal energy of the heat generating member can be used for the vaporization of the liquid fuel with a further improved efficiency for savings in energy.

Various other features and advantages of the invention will be readily understood from the following description of preferred embodiments with reference to the accompanying drawings, in which:

FIG. 1 is a view in vertical section showing a liquid fuel vaporizer which is a chief component of a liquid fuel combustion apparatus according to this invention to illustrate the principle;

FIG. 2*a* is a front view showing a liquid fuel drawing-up member for use in the vaporizer of FIG. 1;

FIG. 2*b* is a side elevation showing the drawing-up member of FIG. 2*a;*

FIG. 3*a* is a front view showing another liquid fuel drawing-up member useful for the vaporizer of FIG. 1;

FIG. 3*b* is a side elevation showing the drawing-up member of FIG. 3*a;*

Figure 6A:
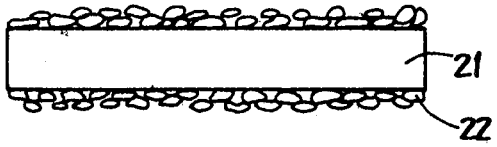
Figure 6B:
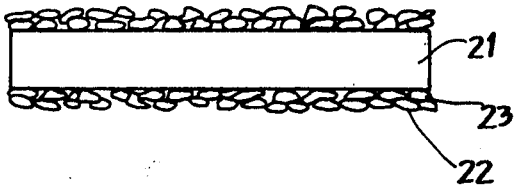
Figure 6C:
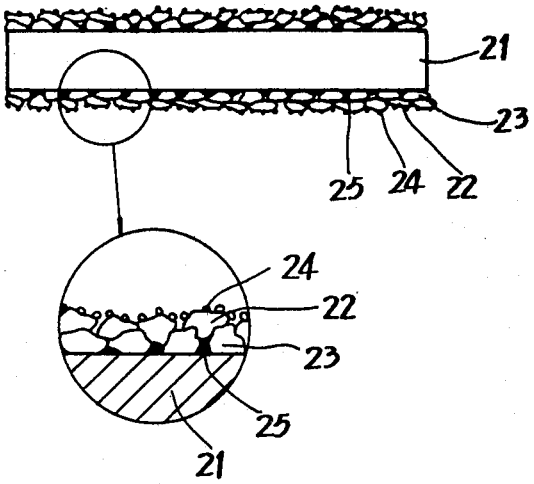
Figure 7A:
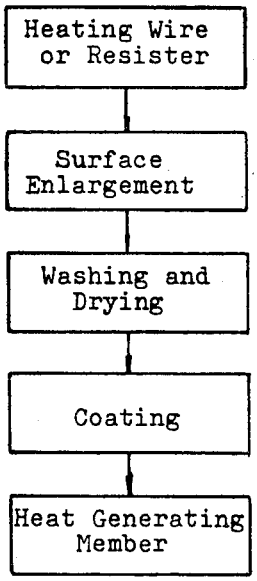

FIG. 6*a* is a fragmentary enlarged view in section showing a first embodiment of the heat generating member;

FIG. 6*b* is a fragmentary enlarged view in section showing a second embodiment of the heat generating member;

FIG. 6*c* is a fragmentary enlarged view in section showing a third embodiment of the heat generating member;

FIG. 7*a* is a diagram illustrating a process for producing the heat generating member of FIG. 6*a;*

Figure 7B:
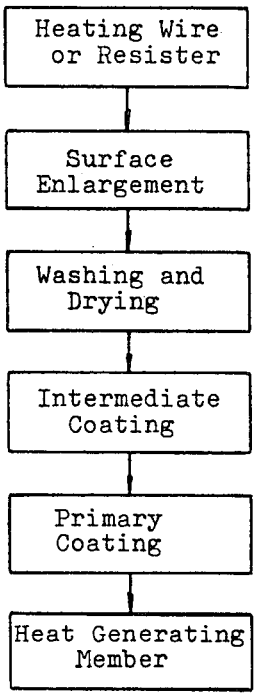
Figure 7C:
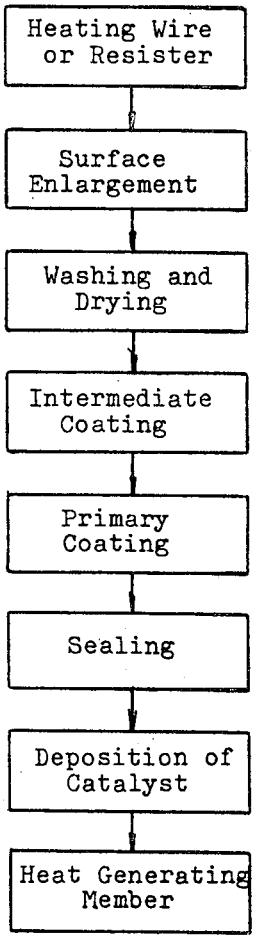

FIG. 7*b* is a diagram showing a process for producing the heat generating member of FIG. 6*b;* and FIG. 7*c* is a diagram showing a process for producing the heat generating member of FIG. 6*c.*

Figure 1:
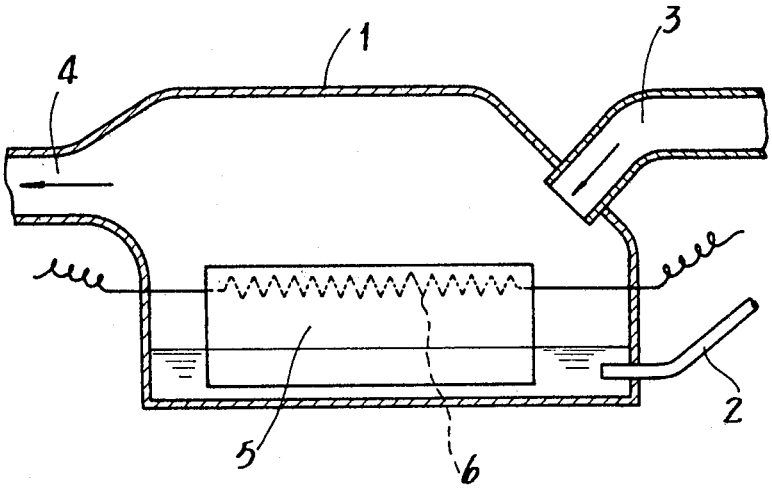

With reference to the liquid fuel vaporizer shown in FIG. 1, the wall of a closed container 1 is formed with an inlet 2 for a liquid fuel such as kerosene, an air inlet 3 and an outlet 4 for a fuel-air gaseous mixture. Disposed within the closed container 1 is a liquid fuel drawing-up member 5 made of a heat-resistant porous material of fabric or glass fiber or like heat-resistent fiber and having a capillary action. A heat generating member 6 having a heat-resistant coating layer on its outer surface is provided in intimate contact with the drawing-up member 5. By virtue of the intimate contact of the heat generating member 6 with the drawing-up member 5, a predominant amount of the heat emitted from the member 6 is efficiently transmitted to the drawing-up member 5 to effectively evaporate and vaporize the liquid fuel drawn up by the member 5. By a capillary action the drawing-up member 5 automatically draws up the liquid fuel at a rate corresponding to the rate of evaporation to maintain a steady state. When the capacity of the member 5 to draw up the liquid fuel, the amount of heat emitted by the heat generating member 6, the surface area of the fuel evaporating and vaporizing portion, etc. are suitably determined relative to one another, the fuel can be vaporized very efficiently relative to the heat supply by the member 6 with high responsiveness.

Since the liquid fuel is vaporized mainly at and around the portion of the drawing-up member 5 in contact with the heat generating member 6, the air inlet 3 is so arranged that the air supplied therethrough will promote vaporization of the liquid fuel and flow out through the outlet 4 as completely admixed with the vaporized fuel. The gaseous mixture thus obtained is led to a particular combustion unit suitable for the contemplated use. This provides a convenient and economical liquid fuel combustion apparatus.

The heat generating member 6, when provided within the drawing-up member 5, is advantageous in evaporating and vaporizing the liquid fuel with improved efficiency. When a PTC thermistor coated with a heat-resistant material is used as the heat generating member 6 as desired, the member 6 is self-controllable to give a specified heating temperature.

Most preferably, the drawing-up member 5 should fulfil the following requirements to attain the objects of the invention.

(1) Having a structure by which the heat emitted by the heat generating member 6 contacting or installed in the drawing-up member 5 can be efficiently converted to the heat of evaporation and vaporization of the liquid fuel.

(2) Being capale of vaporizing the liquid fuel in a variable amount in accordance with the amount of heat emitted by the heat generating member 6.

(3) Having an outstanding capillary action and a small thermal capacity.

(4) Having minimized susceptibility to the formation of tar and like deposits at the portion thereof for evaporating and vaporizing the fuel.

(5) Being made of a heat-resistant and corrosion-resistant material.

(6) Being serviceable as a carrier for a catalyst and capable of fully withstanding the process for depositing the catalyst thereon.

A detailed description will now be given of the materials for drawing-up members filfilling these requirements and the catalysts to be deposited on the surface of the drawing-up members.

First, useful drawing-up members will be described which have a capillary action and made from heat-resistant porous materials.

HEAT-RESISTANT POROUS MATERIALS

Figure 2A:
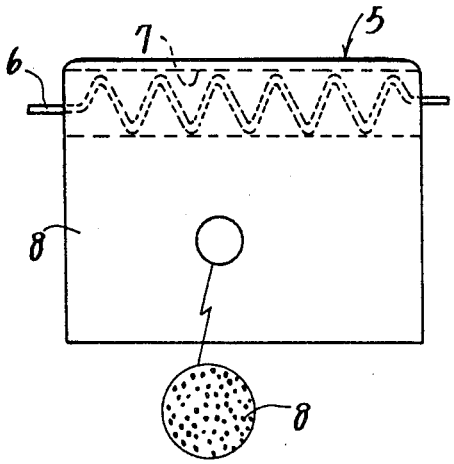
Figure 2B:
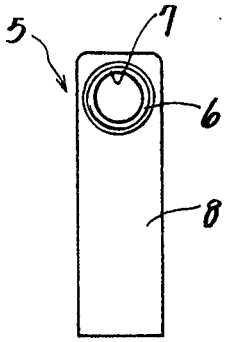

Heat-resistant ceramics are usable as heat-resistant porous materials. Such ceramics must be porous and capable of drawing up the liquid fuel by a capillary action and are preferably foamed bodies. Useful ceramic materials are alumina, magnesia, clay, silica and zirconia which are resistant to heat. Heat-resistant foamed ceramics can be prepared, for example, from a mixture of a ceramic material of the clay type and a required amount of finely divided graphite for blowing the material during baking at a high temperature, by a known method involving molding, drying and baking. Preferably the drawing-up member 5 made of such a heat-resistant porous material has the construction shown in FIGS. 2*a* and 2*b*. It is seen that the heat-resistant ceramic body 8 of the member is formed with a bore 7 extending therethrough for accommodating the heat generating member 6.

Since the porosity of the heat-resistant ceramic body 8 is inherently limited with a limitation on its ability to draw up the liquid fuel, it is preferable to use heat-resistant fiber for drawing-up members for small-sized combustion apparatus with relatively small heat output.

HEAT-RESISTANT FIBERS

Figure 3A:
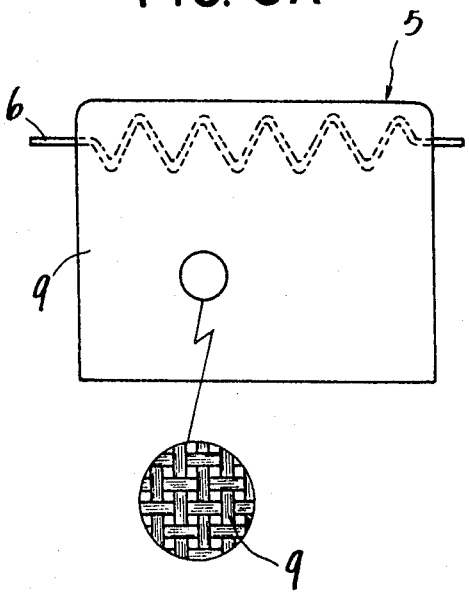
Figure 3B:
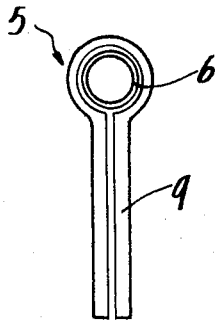

Drawing-up members of heat-resistant fibers, especially heat-resistant inorganic fibers, draw up liquid fuels most efficiently when made of fabric woven from bundled yarns of monofilaments in a reticular form. However, nonwoven fabrics and mats are still superior to the above-mentioned heat-resistant porous materials. Extensive research has revealed that preferable heat-resistant inorganic fibers are glass fiber, de-alkalized glass fiber, silica fiber, alumina fiber, carbon fiber and asbestos fiber, among which glass fiber and dealkalized glass fiber are most preferable from the overall viewpoint in respect of the stability of quality, variety, economy, processability, etc. Furthermore such fibers achieve the highest vaporization efficiency. The drawing-up member 5, when made from such heat-resistant inorganic fiber, preferably has the structure shown in FIGS. 3*a* and 3*b* in which a heat-resistant fiber fabric 9 surrounds the heat generating member 6.

When the drawing-up member 5 is in the form of a heat-resistant ceramic body 8, the member 5 can be made to support thereon a material, such as active alumina, colloidal silica or the like, which is active and has an increased surface area, in order to compensate for the small surface area of the body 8. On the other hand, the heat-resistant fiber material 9 usually has a larger active surface area than ceramics and is therefore fully useful as it is. To be more efficient, however, the fiber material can be made to support active alumina, colloidal silica, or the like thereon.

Figure 4:
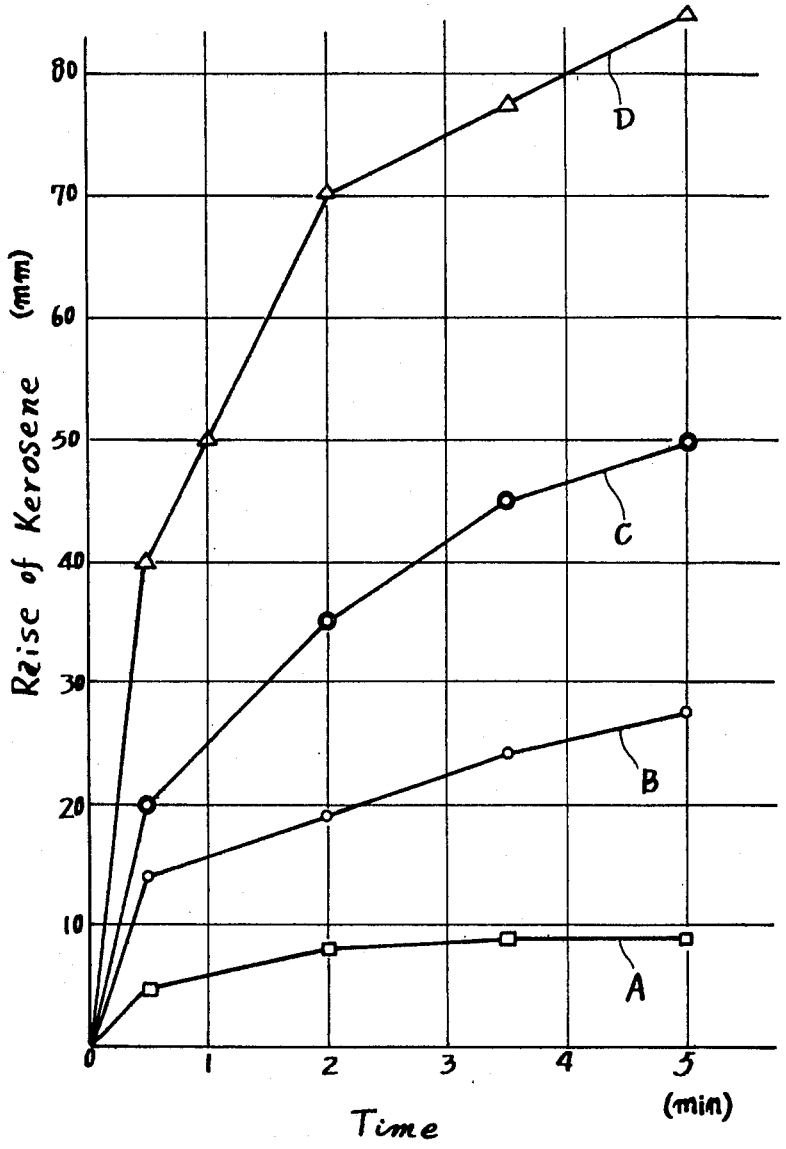
FIG. 4 is a diagram showing the characteristics of various liquid fuel drawing-up members.

Preferably the fuel drawing-up member 5 made of such heat-resistant porous or fibrous material has the ability to draw up the liquid fuel at a speed of at least 10 mm/30 seconds to inhibit deposition of tar on the fuel evaporating and vaporizing portion of the member 5 that would lead to improper combustion. For the selection of materials meeting this requirement, various materials are cut to a width of 70 mm and a length of 150 mm, immersed the lower ends of the cut pieces into kerosene, an example of liquid fuels, to measure the heights to which the materials draw up the kerosene by the capillary action. The results are shown in FIG. 4, in which A represents the characteristics of a drawing-up member of clay biscuit. B represents the characteristics of a drawing-up member in the form of a porous foam biscuit prepared from a mixture of clay and finely divided graphite by molding, drying and baking. C represent those of a member of plain-woven fabric formed from bundled yarns of glass fiber. D represents those of a member made of a fabric resembling a plain gauze, formed from thicker bundled glass fiber yarns and having larger openings. FIG. 4 reveals that the height to which the kerosene can be drawn up per unit time differs greatly from member to member in accordance with the material, process of production and structure of the member.

While the formation of tar can be inhibited considerably with the use of drawing-up members having a liquid fuel drawing-up speed of at least 10 mm/30 seconds, the tar can be inhibited more effectively by a catalyst deposited at least on the surface of the fuel evaporating and vaporing portion of the drawing-up member. Such catalysts will now be described.

CATALYSTS

The catalysts to be used in this invention act to crack the liquid fuel to lower-molecular-weight substances and to inhibit the formation of tar, carbon and other deposits or to decompose such deposits at low temperatures. Although the term "catalyst" generally refers to a material comprising a carrier and a catalytically active substance deposited on the carrier, the term "catalyst" as used in this invention means the catalytically active substance itself for the convenience of description since the drawing-up member or the heat generating member to be described later serves as the carrier in this invention. Typical of catalysts useful in this invention are so-called metallic oxide catalysts such as $MnO_x$, $CuO_x$, $NiO_x$, $CoO_x$, $FeO_x$, $CrO_x$, $AgO_x$, $VO_x$, etc.; double oxide catalysts such as ferrite, zeolite, silica-alumina, cement, etc.; and noble metal catalysts such as Pt, Rh, Pd, Ir, Ru, etc. Useful catalysts further include those widely used in catalytic chemistry, examples of which are solid acid catalysts including (1) natural clay minerals such as Japanese clay acid, kaolin, monmorillonite, (2) solid acids such as $H_2SO_4$, $H_3PO_4$, etc. as adsorbed in carriers, (3) silica-alumina, silica-magnesia, etc. and (4) inorganic chemicals such as ZnO, $Al_2O_3$, $TiO_2$, $CaSO_4$, $CuCl_2$, etc.; and solid base catalysts including (1) inorganic chemicals such as CaO, MgO, $K_2CO_3$, $BaCO_3$, etc., (2) sodium hydroxide as adsorbed to an alumina catalyst and (3) charcoal activated with nitrous oxide. Among these catalysts, noble metal catalysts are especially effective for decomposing tar, carbon and like deposits at low temperatures. With use of a drawing-up member having 0.001% to 5.0% by weight of such a noble metal catalyst deposited thereon, the liquid fuel can be handled as if it were a gas fuel. These catalysts may be used singly or in admixture as desired.

The catalyst may be deposited on the drawing-up member directly or by some other method. In the case of $MnO_x$ catalyst, for example, a solution of $Mn(NO_3)_2$ serving as a starting material is applied to the carrier, namely, to the drawing-up member by immersion or spraying, followed by heat treatment to form $MnO_x$. Further in the case of Pt catalyst, the carrier can be made to support the catalyst thereon by dissolving chloroplatinic acid ($H_2PtCl_6$) in a solvent mixture of water and ethyl alcohol, applying the solution to the carrier by immersion or spraying and heat-treating the resulting carrier.

Figure 5:
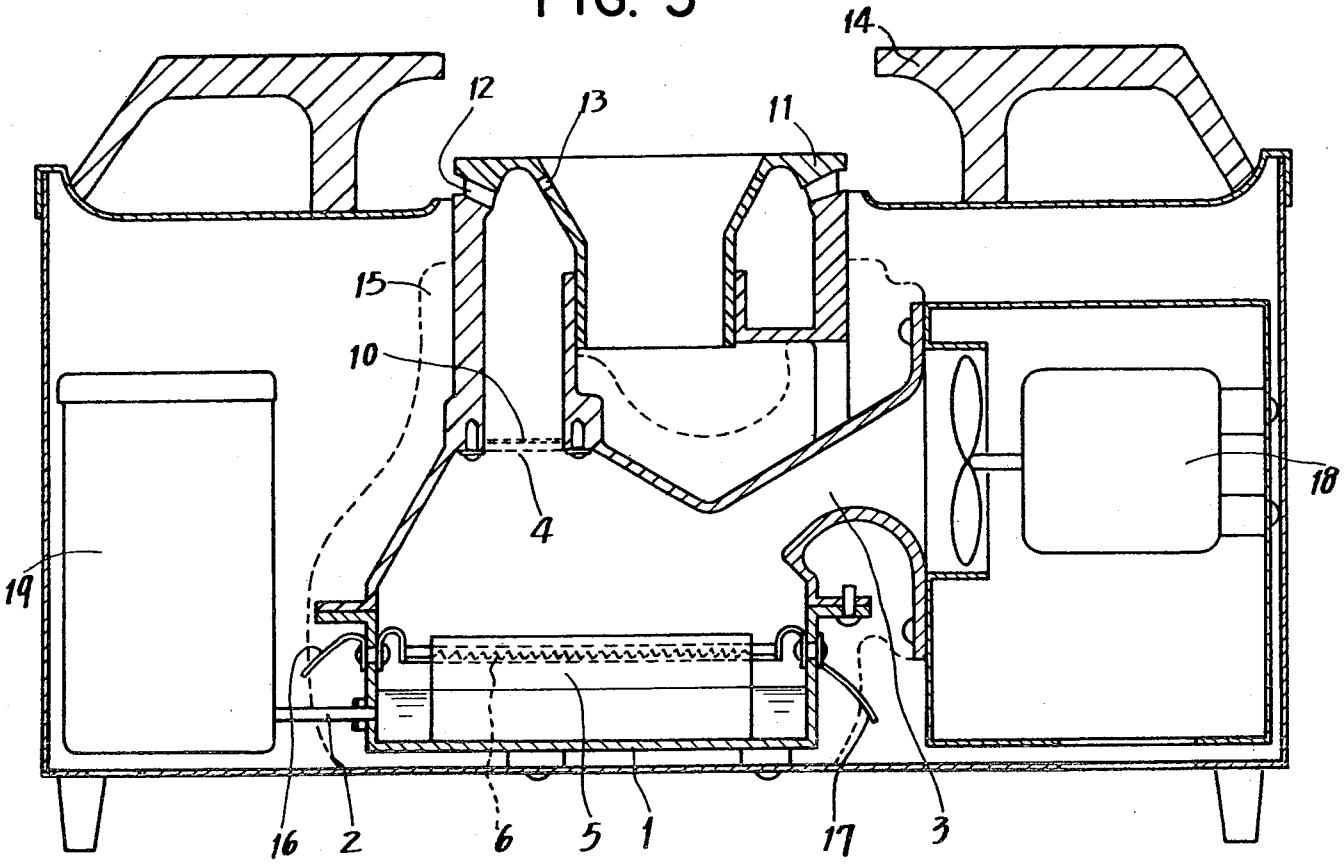
FIG. 5 is a view in vertical section showing a specific embodiment of the liquid fuel combustion apparatus of the invention.

With reference to FIG. 5, a specific embodiment will be described in which the liquid fuel vaporizer of FIG. 1 is incorporated in a liquid fuel combustion apparatus. The parts shown in FIG. 5 and substantially identical with those shown in FIG. 1 are referred to by the same reference numerals and will not be described. A combustion unit 11 comprising a burner for a small kitchen range is installed on a fuel-air gaseous mixture outlet 4, with a backfire preventing net 10 provided therebetween. The fuel-air mixture burns to force out flames through apertures 12 and 13. Indicated at 14 is a trivet, and at 15 a heat insulator for a closed container 1. A heat generating member 6 has input terminals 16 and 17. Air is fed by a fan 18, while a leveler 19 maintains the liquid fuel, such as kerosene, at a constant level for the supply of the fuel. The amount of combustion is widely variable by adjusting the input to the heat generating member 6 and the supply of air by the fan 18.

A combustion experiment was conducted with use of various liquid fuel drawing-up members 5 for the apparatus of FIG. 5. Eight drawing-up members were tested. They are the drawing-up members A to D already described with reference to FIG. 4, and drawing-up members A' to D' prepared by causing the same kinds of members to support a catalyst thereon. For this purpose, a platinum catalyst was deposited on each member by dissolving chloroplatinic acid ($H_2PtCl_6$) in a mixture of water and ethyl alcohol to a concentration of 2 g/liter calculated as platinum, spraying the solution to the member in an amount of 0.01% by weight calculated as platinum and based on the weight of the member, drying the member and thereafter baking the member at 600° C. The heat generating member 6 was prepared by coating a 15-ohm electric heating wire with finely divided alumina to a uniform thickness of 30 to 50$\mu$ by arc metal spray method. The output of the heat generating member 6 was adjusted to 40 W or 60 W to check the apparatus for the variations in the amount of heat generated in each case. The time taken for the formation of tar on each drawing-up member was also measured. Table 1 shows the results.

TABLE 1

| Liquid fuel drawing-up member | | | Rise of kerosene | Heat output (Kcal/h) | | Time taken for formation of tar |
|---|---|---|---|---|---|---|
| No. | Base | Catalyst | (mm/30 sec) | 40 W | 60 W | 40 W (hours) |
| 1 | A, Clay biscuit | None | 5 | 980 | 1450 | 4 |
| 2 | B, Foam biscuit of clay | None | 10 | 1100 | 1800 | 23 |
| 3 | C, Glass fiber fabric (plain weave) | None | 20 | 1480 | 2550 | 58 |
| 4 | D, Glass fiber fabric* | None | 40 | 1700 | 3150 | 94 |
| 5 | A', Clay biscuit | With catalyst | 5 | 1050 | 1460 | 33 |
| 6 | B', Foam biscuit of clay | With catalyst | 10 | 1100 | 1860 | 285 |
| 7 | C', Glass fiber fabric (plain weave) | With catalyst | 20 | 1520 | 2650 | At least 1000 |
| 8 | D', Glass fiber fabric* | With catalyst | 40 | 1820 | 3350 | At least 1000 |

*Resembling a plain gauze, having larger openings and formed of yarns of larger diameter.

Based on the experimental results given in Table 1, the desirable characteristics of liquid fuel drawing-up members for attaining the foregoing objects of the invention will be discussed.

While both the members No. 1 and No. 2 are heat-resistant porous bodies made chiefly of clay, No. 2 has a higher porosity and higher ability to draw up kerosene, affords increased heat output, namely, an increased amount of heat and is operable for a longer period of time free of formation of tar.

Although No. 3 and No. 4 are woven of the same glass fiber, they differ in the thickness of bundled glass fiber yarns and in the method of weaving and therefore greatly differ in capillary attraction. No. 4 is superior in the ability to raise kerosene, heat output and tar formation time.

The drawing-up members No. 5 to No. 8, having 0.01% by weight of platinum catalyst deposited on the base body, achieved remarkable improvements in all the characteristics over the members No. 1 to No. 4 bearing no catalyst. It is noted that the improved characteristics are substantially dependent largely on the kerosene raising ability of the base bodies.

These results have revealed that drawing-up members having ability to draw up kerosene at a speed of at least 10 mm/30 seconds are fully useful for the evaporator of the liquid fuel combustion apparatus contemplated by the present invention. Drawing-up members having lower ability, like the member No. 1 listed in Table 1, will permit deposition of tar on the porous body thereof within a short period of time and consequently become unserviceable for the vaporizer. Thus in order to fulfill the objects of the invention, the liquid fuel drawing-up member must be capable of drawing up the fuel at a rate of at least 10 mm/30 seconds. Especially when having ability of not lower than 20 mm/30 seconds, the drawing-up member exhibits stable characteristics for a further prolonged period of time.

Extensive research conducted has indicated that porous ceramics capable of drawing up a liquid fuel, e.g., kerosene at a rate of at least 10 mm/30 seconds can be prepared by using at least one of the heat-resistant materials exemplified above conjointly with finely divided graphite, $CaF_2$, $MgF_2$ or the like serving as a blowing agent for baking at a high temperature.

Although the invention has been described above as embodied for use with kerosene, experiments have shown that exactly the same results are achievable with use of other liquid fuels such as gas oil.

The heat generating member 6 will be described in greater detail.

Most suitably, the heat generating member 6 should fulfill the following requirements for attaining the objects of the invention.

(1) Being held in intimate contact with the liquid fuel drawing-up member 5 to the greatest possible extent and over the largest possible area.
(2) Being capable of subjecting the generated heat to heat exchange with the liquid fuel or the drawing-up member 5.
(3) Freedom from local heating to a high temperature over the surface thereof.
(4) Freedom from tar-like unburned deposits over its surface.
(5) Having the function of catalytically self-cleaning its surface to eliminate tar-like unburned deposits, if any.
(6) Being capable of maintaining a uniform surface temperature in the range of 200° to 250° C.
(7) Having its metal portion protected against corrosion due to cementation.

When the heat generating member 6 comprises a sheathed heater, a usual heating wire, for example, of Fe—Cr—Al, Fe—Ni—Cr or Fe—Ni—Cr—Al—Yt alloy, or the like, tar-like unburned products will be deposited on its surface in a short period of time, consequently impairing the heat exchange for affording the heat of vaporization or locally subjecting the sheathed heater or wire to cementation that could lead to local overheating or a break or cause ignition of the gaseous mixture.

Accordingly it is preferable to coat the heat generating member with at least one layer of a heat-resistant metal such as Al, Zn, Sn, Cr, Cu, Fe, Ni or the like, a heat-resistant alloy such as Ni—Cr—Al, Ni—Cr, Fe—Cr, Fe—Cr—Al, Fe—Ni—Cr—Al, Fe—Ni—Cr or the like, or a heat-resistant metallic oxide. It is also preferable to cause the coating layer to support a catalyst on its surface.

With reference to FIGS. *6a* to *6c*, heat generating members 6 useful in this invention will be described. FIG. *6a* shows an embodiment comprising a heating wire or resistor 21 coated with a layer 22 of metallic oxide (or double metallic oxide). Since the preferred surface temperature of the heat generating member 6 is 200° to 250° C., the thermal expansion of the resistor 21 is not very great, so that this embodiment is formed by coating the resistor 21 directly with a metallic oxide, such as $Al_2O_5$, $TiO_2$, $MgAl_2O_4$ or the like, or a double oxide of metal by the plasma spray method.

FIG. *6b* shows another embodiment comprising a heating wire or resistor 21, an intermediate layer 23 of heat-resistant alloy coating the resistor 21 and a layer 22 coating the intermediate layer 23 and made of metallic oxide (or double metallic oxide) like the coating layer of FIG. *6a*. This embodiment is fully serviceable for a prolonged period of time under heat cycles when the resistor 21 and the metallic oxide layer 22 differ greatly in thermal expansion. Heat-resistant alloys, such as Ni—Cr, Ni—Cr—Al or the like, are useful for the intermediate layer 23.

The embodiment of FIG. *6b* is further treated with a sealant 25 and provided with a catalyst 24 to give the embodiment shown in FIG. *6c*.

The heat generating members 6 of FIGS. *6a*, *6b* and *6c* are prepared by the processes illustrated in FIGS. *7a*, *7b* and *7c*, respectively and to be described below in detail.

HEAT GENERATING SOURCES

Examples of the most preferable heat generating sources are coils of nichrome wire, iron wire, chromium wire, Kanthal alloy wire, Ni—Cr—Fe—Y wire and the like. Although sheathed heaters, PTC thermistors and other heating surces are usable, usual heating wires such as nichrome wire are used for the embodiments.

SURFACE ENLARGEMENT

The surface of the heating wire is fully degreased and cleaned first and subsequently treated for enlargement with a usual abrasive of $Al_2O_3$, SiC or the like, 20 to 100 mesh in particle size, at a blast pressure of 3 to 5 kg/cm$^2$. Preferably the heating wire is treated to an average roughness (Ra) of 5 to 50$\mu$ as measured by "TALISURF 10," an instrument for the measurement of surface roughness by the stylus method. If the Ra value is lower than 5$\mu$, the heating wire will not be coated with a heat-resistant material effectively, whereas Ra values exceeding 50$\mu$ entail difficulties in uniformly coating the heating wire.

WASHING AND DRYING

The heating wire is then washed with water to remove abrasive particles and particles of the wire metal and is thereafter thoroughly dried at 100° to 150° C.

COATING (PRIMARY COATING)

If the heating wire is held directly in intimate contact with the liquid fuel drawing-up member 5 or the liquid fuel, accelerated formation of tar takes place on the surface of the wire, consequently subjecting the wire to corrosion due to cementation with the tar. To avoid this, the heating wire is coated with a layer of heat-resistant metal, heat-resistant alloy or heat-resistant metallic oxide. Preferably the coating layer is formed from a heat-resistant metallic oxide which itself is capable of catalytically cracking liquid fuels, such as kerosene, and tar-like substances. Examples of suitable metallic oxides are $Al_2O_3$, $SiO_2$, $Fe_2O_3$, $Y_2O_3$, $TiO_2$, CaO, $B_2O_3$, $Li_2O$, $Cr_2O_3$, $ZrO_2$, MgO, BeO, NiO, $ThO_2$, $HfO_2$, $La_2O_3$ and $CeO_2$. Also suitable are double oxides of spinel structure, such as $MgAl_2O_4$, $MnAl_2O_4$, $FeAl_2O_4$, $CoAl_2O_4$, $ZnAl_2O_4$, $MgCr_2O_4$, etc. These oxides are used singly or in admixture. Among these examples, $Al_2O_3$, $TiO_2$, $ZrO_2$, $SiO_2$ and $MgAl_2O_4$ are most effective and also economical.

These substances can be applied to the heating wire by the arc, flame, plasma and explosion metal spray methods, while the plasma metal spray method was employed for the present embodiments, using "PLASMATRON," (trade name, product of Plasmadyne, a division of Geotel, Inc.) 80 KW type Model SG-100. Argon gas was used as the arc gas, and helium as an auxiliary gas. The heat-resistant coating material was sprayed onto the wire with a power supply of 1000 A, 41 V for coating.

Coating layers of about 10 to about 100μ proved effective.

INTERMEDIATE COATING

As already stated, the intermediate layer, when provided between the heating wire or resistor 21 and the metallic oxide layer 22, renders the wire usable stably for a prolonged period of time under heat cycles. Examples of the most suitable materials for the intermediate coating layer are heat-resistant alloys, such as Ni—Cr, Ni—Cr—Al, Fe—Cr, Fe—Cr—Al, Fe—Cr—Ni—Al, etc., and heat-resistant metals, such as Al, Zn, Sn, Cr, Cu, Fe, Ni, etc.

At least one of these heat-resistant alloys and metals is applied to the wire. Preferably the intermediate coating layers are formed by metal spray methods, such as those mentioned above. Good results were obtained when the intermediate layer has a thickness of about 5 to about 30μ.

SEALING

When the heating wire or resistor 21 is coated with the intermediate layer of alloy such as Ni—Cr—Al by the metal spray method and further coated with a ceramic material, such as $TiO_2$, $Al_2O_3$, $SiO_2$ or $ZrO_2$, by the plasma spray method to form a primary coating layer thereon, the metal spray layers, which have a substantial porosity of 5 to 30%, will permit the liquid fuel to penetrate therethrough to the surface of the heating wire. Since the interface between the heating wire or resistor 21 and the intermediate layer involves difficulty in permitting diffusion of air and therefore presence of a substantial amount of oxygen, the liquid fuel penetrating to the wire surface is liable to become tar, which is difficult to oxidize and burn. To avoid such an objectionable result, it is preferable to seal off the interface.

Examples of useful sealants for this purpose are water glass, silica sol, alumina sol, vitreous powder, silicone resin and heat-resistant coating compositions. Among these examples, water glass, silica sol and alumina sol were found to be especially useful.

DEPOSITION OF CATALYST

Although the metallic oxide coating layer 22 itself has a self-cleaning function by partly cracking kerosene and tar-like substances, the layer will have greatly improved ability to crack kerosene and tar-like substances for self-cleaning when made to support a noble metal or like catalyst on the surface thereof.

Catalysts useful for this purpose are those already exemplified for deposition on the drawing-up member, among which noble metal catalysts are especially desirable similarly. Such a noble metal catalyst can be deposited on the oxide coating layer by dissolving a chloride of the noble metal in a solvent mixture of water and alcohol to a concentration of 1 to 10 g/liter, impregnating the layer with the solution, drying the wet layer at 100° to 150° C. and baking the same in an electric oven at 600° C. FIG. 6c shows the coating layer thus supporting the noble metal catalyst on its surface.

For comparison, a commercial nichrome wire 0.4 mm in diameter was wound into a coil having an inside diameter of 4 mm and an overall resistivity of 15 ohms, and this heat generating member was tested with a power supply of 60 W with use of the apparatus of FIG. 1. Tar was formed about 20 to 30 hours after the start-up, and the heat generating member was found to have been wholly covered with tar when used continuously for about 400 to about 500 hours. By this time, the initial resistivity of 15 ohms had increased to 196 ohms, with a greatly reduced fuel vaporization efficiency.

On the other hand, a nichrome wire of the same size was coated with a metallic oxide layer 22 only by the process shown in FIG. 7a to obtain a heat generating member shown in FIG. 6a. The same kind of wire was also treated by the process shown in FIG. 7c to obtain a heat generating member as shown in FIG. 6c and having an intermediate layer, a primary coating layer, a sealing layer and a platinum catalyst deposited on the coating layer. These heat generating members were continuously used in the same manner as bove. In 2000 hours, the former member with the metallic oxide layer 22 alone was found to have its initial resistivity of 15 ohms increased to 165 ohms although still continuously usable. No changes were found in the resistivity of the latter heat generating member even after the lapse of 2000 hours.

What is claimed is:

1. An apparatus equipped with a heating-type fuel vaporizer for burning a liquid fuel and comprising:

a member immersed in the liquid fuel for drawing up the fuel in a liquid state, the drawing-up member being capable of drawing up the liquid fuel at a speed of at least 10 mm/30 seconds, means for supplying the liquid fuel to the drawing-up member, a heat generating member embedded in the drawing-up member in contact therewith for giving heat to the liquid fuel drawn up by the drawing-up member, said heat generating member being coated over the outer surface thereof with at least one layer made from at least one member selected from the group consisting of heat-resistant metal, heat-resistant alloy and heat-resistant metallic oxide; and a combustion unit for burning the fuel evaporated and vaporized by the heat emitted by the heat generating member.

2. An apparatus as defined in claim 1 wherein the heat-resistant metallic oxide is at least one compound selected from the group consisting of metallic oxides including $Al_2O_3$, $SiO_2$, $Fe_2O_3$, $Y_2O_3$, $TiO_2$, CaO, $B_2O_3$, $Li_2O$, $Cr_2O_3$, $ZrO_2$, MgO, BeO, NiO, $ThO_2$, $HfO_2$, $La_2O_3$ and $CeO_2$ and double metallic oxides having a spinel structure and including $MgAl_2O_4$, $MnAl_2O_4$, $FeAl_2O_4$, $CoAl_2O_4$, $ZnAl_2O_4$ and $MgCrO_4$.

3. An apparatus as defined in claim 1 wherein the heat-resistant metal is at least one member selected from the group consisting of Al, Zn, Sn, Cr, Cu, Fe and Ni.

4. An apparatus as defined in claim 1 wherein the heat-resistant alloy is at least one member selected from the group consisting of Ni—Cr—Al, Ni—Cr, Fe—Cr, Fe—Cr—Al, Fe—Ni—Cr—Al and Fe—Ni—Cr.

5. An apparatus as defined in claim 1 wherein the coating layer has a catalyst deposited on the outer surface thereof.

6. An apparatus as defined in claim 5 wherein the catalyst is at least one member selected from the group consisting of metallic oxide catalysts, double oxide catalysts, noble metal catalysts, solid acid catalysts and solid base catalysts.

* * * * *